United States Patent [19]

Rasmussen

[11] 4,098,925

[45] Jul. 4, 1978

[54] METHOD FOR PROTECTING SHIPS AGAINST FOULING

[76] Inventor: Oystein E. Rasmussen, Hosleveien 119, 1340 Bekkestua, Norway

[21] Appl. No.: 768,891

[22] Filed: Feb. 15, 1977

[30] Foreign Application Priority Data

Feb. 26, 1976 [NO] Norway ..... 760651

[51] Int. Cl.[2] ..... B63B 59/00; B05D 1/36; B05D 3/12; B05D 5/08

[52] U.S. Cl. ..... 427/154; 427/155; 427/156; 427/368; 427/375; 427/377; 427/416

[58] Field of Search ..... 427/416, 368, 375, 377, 427/154, 155, 156

[56] References Cited

U.S. PATENT DOCUMENTS

| | | | |
|---|---|---|---|
| 2,838,419 | 6/1958 | Francis | 427/416 X |
| 3,806,352 | 4/1974 | Kirksaeter et al. | 427/416 X |
| 4,020,200 | 4/1977 | Groszek et al. | 427/416 |

*Primary Examiner*—James R. Hoffman

*Attorney, Agent, or Firm*—Cushman, Darby & Cushman

[57] ABSTRACT

To protect the underwater surfaces of a ship against fouling and corrosion, several layers of wax are applied, one layer on top of the next but each layer having a successively lower melting point and/or degree of hardness. After a certain length of time, when the outermost layer of the treated surface has become fouled or roughened in some way, it is thus possible to remove whichever layer is outermost by melting or brushing, since the treatment can be regulated such that the underlying layer(s) will not be affected.

10 Claims, No Drawings

METHOD FOR PROTECTING SHIPS AGAINST FOULING

The invention relates to a method for protecting ships against fouling and corrosion through the application of a coating of wax to the underwater surfaces of a ship, this wax layer optionally being applied on top of an intermediate layer of an anti-fouling composition.

The most common method of protecting the underwater surfaces of a ship against fouling is to apply a coating which includes an anti-fouling composition to these surfaces. However, experience has shown that, under unfavorable conditions, fouling can occur relatively quickly even on these coatings, with a resultant decrease in speed or increase in fuel consumption for the ship. Therefore, brushing systems for regularly brushing the underwater surfaces to remove the fouling matter have been developed. In practice, however, it has been shown that fouling of the underwater surfaces occurs again relatively soon after such brushing.

Attempts to reactivate the anti-fouling coating have also been made, where one grinds off the outermost layer of the coating with stiff brushes, thus exposing an inner layer of the anti-fouling composition, such that the preventive toxicants can once more work actively on the surface of the coating. However, during this process some of the toxicants in the film of paint will be brushed off and will sink to the bottom, thereby contaminating the environment. The same problem occurs when the toxic paint is applied to the ship in dry dock, because remains of paint will be rinsed off in the sea when the ship is launched.

Recently, new anti-fouling systems have been developed based on the use of wax, either alone, since the wax by itself will have a certain anti-fouling effect, or in systems where the wax is added an anti-growth composition. Such systems have the advantage, among other things, that when using this system to protect a ship which is lying still for a long period of time and which thus will also be extremely fouled, the entire coating of wax can be removed by washing it down or by brushing it off. Under normal operating conditions, any fouling agents which are firmly attached to the underwater ship surfaces can also be removed much more easily from the wax coating than from the conventional coatings, since the roots, especially of algae, do not penetrate deeply into the wax coating, but remain on the surface. With the conventional anti-fouling paints, one has not been able to remove these roots by brushing, so that one has in reality merely cut off the "grass" that has grown on the side of the ship.

It has proved to be a frequent occurrence, in today's shipping conditions, that a ship is forced to lie up for an extended period of time, either because of a lack of cargo or due to cargo accumulating in the harbors. When a ship lies still over an extended period of time, its underwater surfaces will become fouled to a greater degree than under normal operation, and it will be necessary to dock the ship earlier than usual. One also has the same problem with ships which are laid up, where one often experiences a greater degree of fouling than when the ship is in operation. Problems of this nature have become especially prevalent in recent years, and no satisfactory solution to these problems has been found.

Therefore, the object of the present invention is to provide a method for protecting ships against fouling and corrosion, whereby these problems are solved. It is a further object of the invention to provide a system of protection which will give longer and better protection for ships in normal operation than the systems known at present.

This purpose is achieved through a method based on the known systems of applying a coating of wax to the underwater surfaces of a ship, and the method according to the invention is characterized by the features disclosed in the claims. The method according to the invention is built on the knowledge that wax can be made having different melting points and various degrees of hardness. Moreover, one has utilized the possibility inherent in fact that the melting temperature of wax lies under 100° C, such that one can utilize the hot water or steam which can be produced on board most ships. By adjusting the water to the correct temperature, one can quite simply melt a layer of wax on the side of a ship by supplying an amount of heat sufficient to melt the wax, and one can also rinse off the wax coating with this water, because the stream of water can be carried to the ship's hull via an enclosure, closed to the outside, in which there is an overpressure. By adjusting the water temperature appropriately, it will thus be possible to supply a specific amount of heat sufficient to melt one layer of wax having a specific melting temperature, without removing an underlying layer of wax having a higher melting temperature. Another possibility for removing the wax is by brushing, where one adjusts the brushing pressure of the hardness of the brush in accordance with the hardness of the wax, such that underlying, harder layers of wax are not attacked. A combination of these two possibilities can also be used. In this way, one can remove layer after layer of wax, thus exposing, at regular intervals, a completely new surface on the underwater parts of the ship's hull. Also, as mentioned previously, because the roots of the algae have only attached themselves to the surface of the wax, one will at the same time remove entirely an incipient fouling, as opposed to the conventional process of brushing the ordinary anti-fouling coating, where the roots of the algae remain embedded in the coating. One thus obtains a significantly more effective cleaning of the surface.

Using wax also has the advantage of reducing contamination of the environment. Wax is lighter than water and will therefore float up to the surface of the water, where it can be collected within a barrier. The coating remains can be collected in this way whether or not the wax has been added an anti-growth composition, so that all of the coating which is removed from the sides of the ship will thus be collected in a simple manner and removed.

The wax is applied in layers having a thickness of, for example, 50 microns. Six layers, for example, can be applied, and experience has shown that it will probably be sufficient to remove one layer every year. One thus obtains a protection extending over six years, without any fouling of the sides of the ship to speak of. In addition, there can be a layer of ordinary anti-fouling composition under the layers of wax, which gives a further extension of protection time.

The wax can be applied in whatever suitable manner is desired, and it can be applied, for example, as a melt, or in the form of a dispersion, emulsion, or the like, by spraying. When applying the various coats of wax, it is practical if one waits until one layer has set before applying the next, but it is also possible to let the layers overlap each other by applying several layers in quick succession. To save time, equipment can be used with which several layers are applied immediately following one another.

The invention will be explained further in the following, through examples of embodiments of the method.

EXAMPLE 1

To the underwater hull of a ship, a wax dispersion of a microwax having a melting point of 71° C is applied by spraying. Over this layer, additional layers of paraffin wax having melting points of 61° C, 55° C, 50° C and 45° C, respectively, are applied by spraying.

After one year's operation of the ship, a washing down of the underwater hull is undertaken using hot water from the ship's own system. The washing-down is performed by a diver, as the temperature of the water is to be held between 45° C and 50° C when it strikes the surface of the wax. The outermost layer of paraffin wax will therefore melt and loosen from the side of the ship, together with the growth of fouling agents. This treatment is repeated once every year, or every time it has been found by observing the ship that the fouling is too great. The temperature of the water, that is, the amount of heat applied, is increased with each treatment in accordance with the melting point for that layer of wax which is outermost. After five years, all of the layers of wax will have been removed, and an underlying antifouling coating of the common, conventional type is then exposed and forms a final protective layer.

EXAMPLE 2

The underwater surfaces of a ship are coated, in a manner corresponding to that in Example 1, with six layers of wax having different degrees of hardness, where hardness is defined as the needle penetration factor at 25° C. The innermost layer will thus have a needle penetration factor of 5, and the following layers 11, 18, 30, 40 and 100, respectively. When the ship bottom has become sufficiently fouled to require cleaning for the first time, the outermost layer of wax is removed by brushing, using brushes of the type commonly used in the brushing of ships. The brushing pressure or the hardness of the brush is regulated in accordance with the degree of hardness of the outermost layer of wax. This process is repeated six times, after which the ship must again be coated with a new system of wax layers.

It should be noted that when using a system of wax coatings, one must make certain that a system which is in accordance with the conditions where the ship is to operate, is applied, such that, for example, in tropical waters, in the area between the light and heavy cargo lines on the hull, a wax which does not melt before reaching a temperature of approximately 58°-60° C is used.

It should also be noted that it is of course possible to remove several layers at a time, should this for some reason be desirable.

EXAMPLE 3

The application is carried out in accordance with Example 1, except that the first layer is applied by spraying on a microcrystalline wax in melted state. An especially good adhesion to the foundation is thereby achieved.

Having described my invention, I claim:

1. A method for protecting a ship against fouling and corrosion by applying a layer of wax to the underwater surfaces of the ship, characterized in that several successive layers of wax coating are applied to the underwater surfaces in sequence, each layer having a successively lower melting point and/or degree of hardness, so that the layers can be removed successively when the surface has been subjected to growth formation.

2. The method according to claim 1, characterized in that the layers are applied successively one at a time and are removed one at a time.

3. The method according to claim 1, characterized in that at least one of the layers of wax contains an antifouling composition.

4. The method according to claim 1, characterized in that the layers of wax are applied in a melted state.

5. The method according to claim 1, characterized in that the layers of wax are applied by spraying.

6. The method according to claim 1, characterized in that the layers of wax are applied as dispersions or emulsions.

7. The method according to claim 1, characterized in that the outermost wax layer of said layers of wax is removed by brushing, at a brush pressure which is regulated in accordance with the hardness of said outermost wax layer and is effective to remove only said outermost layer.

8. The method according to claim 1, characterized in that the outermost layer of said layers of wax is removed by washing down with hot water or steam, wherein both the temperature of said steam and the volume of said steam are adjusted to provide heat which is effective to melt said outermost wax layer.

9. The method according to claim 1, characterized in that the coatings of wax are applied in layers, with a difference in the melting temperature between successive layers of at least 2° C.

10. The method of claim 9, wherein the difference in the melting temperature ranges from 5° C to 10° C.

* * * * *